US006707440B2

(12) United States Patent
Aoki

(10) Patent No.: US 6,707,440 B2
(45) Date of Patent: Mar. 16, 2004

(54) SEMICONDUCTOR DEVICE

(75) Inventor: Shigeki Aoki, Shiojiri (JP)

(73) Assignee: Seiko Epson Corporation (JP)

( * ) Notice: Subject to any disclaimer, the term of this patent is extended or adjusted under 35 U.S.C. 154(b) by 198 days.

(21) Appl. No.: 09/997,225

(22) Filed: Nov. 29, 2001

(65) Prior Publication Data

US 2002/0083219 A1 Jun. 27, 2002

(30) Foreign Application Priority Data

Dec. 11, 2000 (JP) ..... 2000-376295

(51) Int. Cl.[7] ..... G09G 3/36

(52) U.S. Cl. ..... 345/87; 345/98

(58) Field of Search ..... 345/187, 98, 204, 345/100, 87, 88; 349/149, 152; 257/180

(56) References Cited

U.S. PATENT DOCUMENTS 6,008,788 A * 12/1999 Ishimaru ..... 345/98
2003/0103390 A1 * 6/2003 Kumagai et al. ..... 365/200

* cited by examiner

*Primary Examiner*—Bipin Shalwala
*Assistant Examiner*—Nitin Patel
(74) *Attorney, Agent, or Firm*—Harness, Dickey & Pierce, P.L.C.

(57) ABSTRACT

A semiconductor device is equipped with segment signal output terminals S1–S160 that output segment signals, common signal output terminals C1–C160 that output common signals, dummy terminals NC1–NC160, input terminals P1–P160, bi-directional shift registers 5–6 that operate to output common output signals from the common signal output terminals C1–C160, a shift direction signal output circuit 7 that controls the shift registers 5–6, a common direction scanning signal input control circuit 8, and a shift register connection control circuit 9.

3 Claims, 6 Drawing Sheets

SEMICONDUCTOR DEVICE

BACKGROUND OF THE INVENTION

1. Technical Field of the Invention

The present invention relates to a semiconductor device (a driver IC) that drives a display device such as an LCD panel.

2. Conventional Art

Conventionally, in order to realize a single chip driver IC with many outputs and narrow pitches for driving an LCD panel, within the chip, a large gap needs to be provided between a segment signal output section and a common signal output section for wirings, or a large output pitch in the common signal output section needs to be provided in view of the mounting balance.

However, this causes a problem in that the chip size of the driver IC becomes larger. Also, when the number of output signals becomes greater, it becomes more difficult to route wirings from the driver IC to an LCD panel, and a frame portion of the LCD panel becomes larger. Furthermore, there is a problem in that wirings of the LCD panel are thin, such that the image quality thereof deteriorates.

Thus, in view of the problems described above, it is an object of the present invention to provide a semiconductor device with many outputs, which facilitates wiring to an image display apparatus and realizes a stable mounting.

SUMMARY OF THE INVENTION

To solve the problems described above, a semiconductor device in accordance with the present invention pertains to a semiconductor device for supplying a first group of drive signals to a first group of signal electrodes and a second group of drive signals to a second group of signal electrodes of an image display apparatus that displays a two-dimensional image, the semiconductor device comprising: a first group of output terminals that are arranged in a first region along a first edge in a longitudinal direction of the semiconductor device, and that output a specified number of drive signals among the first group of drive signals to the image display apparatus; a second group of output terminals that are arranged in a second region along the first edge and adjacent to the first region, and that output the second group of drive signals to the image display apparatus; a third group of output terminals that are arranged in a third region along the first edge and adjacent to the second region, and that output the remaining drive signals among the first group of drive signals to the image display apparatus; a first bi-directional register that supplies the first group of drive signals, which are successively input, to the first group of output terminals, respectively, in an order determined by a control signal; a second bi-directional register that is cascade-connected to the first bi-directional register and that supplies the first group of drive signals, which are successively input, to the third group of output terminals, respectively, in an order determined by a control signal; a first group of dummy terminals arranged corresponding to the first group of output terminals along a second edge in the longitudinal direction of the semiconductor device; and a second group of dummy terminals arranged corresponding to the third group of output terminals along the second edge.

Here, the image display apparatus may be a liquid crystal display apparatus, the first group of drive signals may be a plurality of common signals that are respectively supplied to a plurality of common electrodes of the liquid crystal display apparatus, and the second group of drive signals may be a plurality of segment signals that are respectively supplied to a plurality of segment electrodes of the liquid crystal display apparatus.

By the semiconductor device thus structured in accordance with the present invention, the first group of drive signals which are successively input are supplied to the first group of output terminals and the third group of output terminals in orders that are determined by control signals, respectively. As a result, wirings in a variety of patterns can be provided between the semiconductor device and the image display apparatus, and wirings to the image display apparatus are facilitated. Furthermore, by using the dummy terminals, a stable mounting is realized.

DETAILED DESCRIPTION OF THE PREFERRED EMBODIMENT

An embodiment of the present invention is described below with reference to the accompanying drawings. It is noted that the same components are referred to by the same reference numbers, and their description is omitted.

Figure 1:
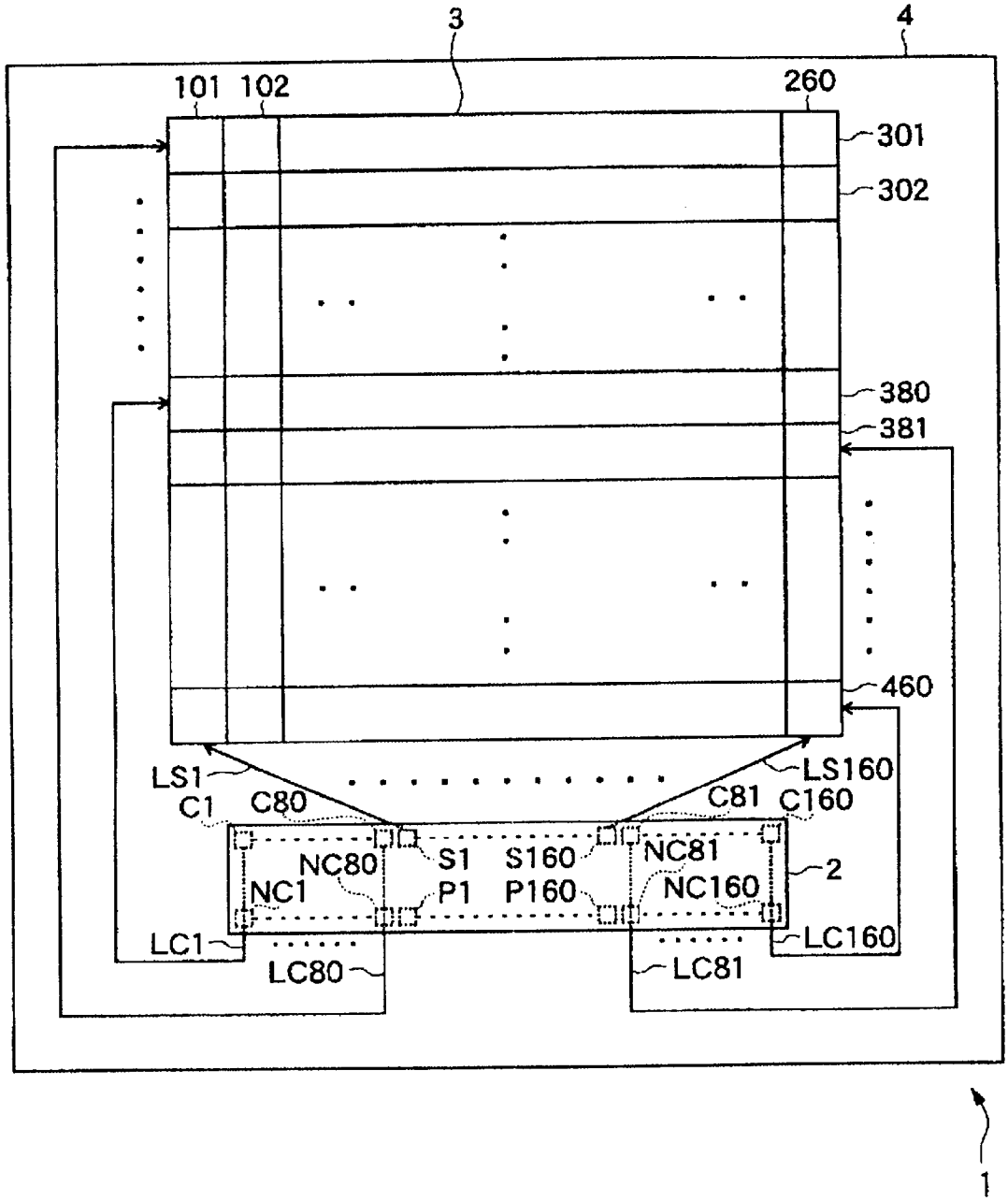
FIG. 1 shows an example of an LCD module using a semiconductor device in accordance with one embodiment of the present invention.

FIG. 1 shows an example of an LCD module using a semiconductor device in accordance with one embodiment of the present invention. In the present embodiment, the present invention is applied to an LCD driver IC.

As shown in FIG. 1, an LCD module 1 includes a driver IC 2, an LCD panel 3 and a glass substrate 4. In other words, the driver IC 2 and the LCD panel 3 are mounted on the glass substrate 4 to form the LCD module 1.

The LCD panel 3 has a plurality of regions 101, 102, . . . in a segment direction, and a plurality of regions 301, 302, . . . in a common direction. Here, by specifying one region in the segment direction and one region in the common direction, one pixel (dot) is specified. As an example, the LCD panel 3 has 160 regions along the segment direction, and also 160 regions along the common direction. In this case, the LCD panel 3 has 160×160 pixels.

The driver IC 2 has an elongated shape in one direction, and segment signal output terminals S1–S160 of gold (Au) bumps for outputting segment signals are formed along a central section of one edge (an upper edge in the figure) in the longitudinal direction of a mounting surface thereof. Also, common signal output terminals C1–C80 and C81–C160 of gold (Au) bumps for outputting common signals are formed along sections on both sides of the central section of the one edge (the upper edge in the figure) in the longitudinal direction of the mounting surface of the driver IC 2. Furthermore, dummy terminals NC1–NC80 and NC81–NC160 are formed in a manner to oppose the common signal output terminals C1–C80 and C81–C160 along another edge (a lower edge in the figure) of the longitudinal direction of the mounting surface of the driver IC 2. Also, input terminals P1–P160 of gold (Au) bumps are formed between the dummy terminals NC1–NC80 and NC81–NC160 along the other edge (a lower edge in the figure) of the longitudinal direction of the mounting surface of the driver IC 2.

Transparent wirings LS1–LS160 and LC1–LC160 are formed on the glass substrate 4. The regions 101–260 of the LCD panel 3 are connected to the segment signal output terminals S1–S160 of the driver IC 2 by the wirings LS1–LS160, respectively. Also, the regions 301–380 of the LCD panel 3 are connected to the common signal output terminals C80–C1 of the driver IC 2 by the wirings LC80–LC1, respectively, and the regions 381–460 of the LCD panel 3 are connected to the common signal output terminals C81–C160 of the driver IC 2 by the wirings LC81–LC160, respectively.

Here, the wirings LC80–LC1 are formed in a manner that they once extend downwardly (in the figure) from the common signal output terminals C80–C1 of the driver IC 2, pass below the dummy terminals NC80–NC1 and then reach the regions 301–380 from the left side of the LCD panel 3. On the other hand, the wirings LC81–LC160 are formed in a manner that they once extend downwardly (in the figure) from the common signal output terminals C81–C160 of the driver IC 2, pass below the dummy terminals NC81–NC160 and then reach the regions 381–460 from the right side of the LCD panel 3.

Figure 2:
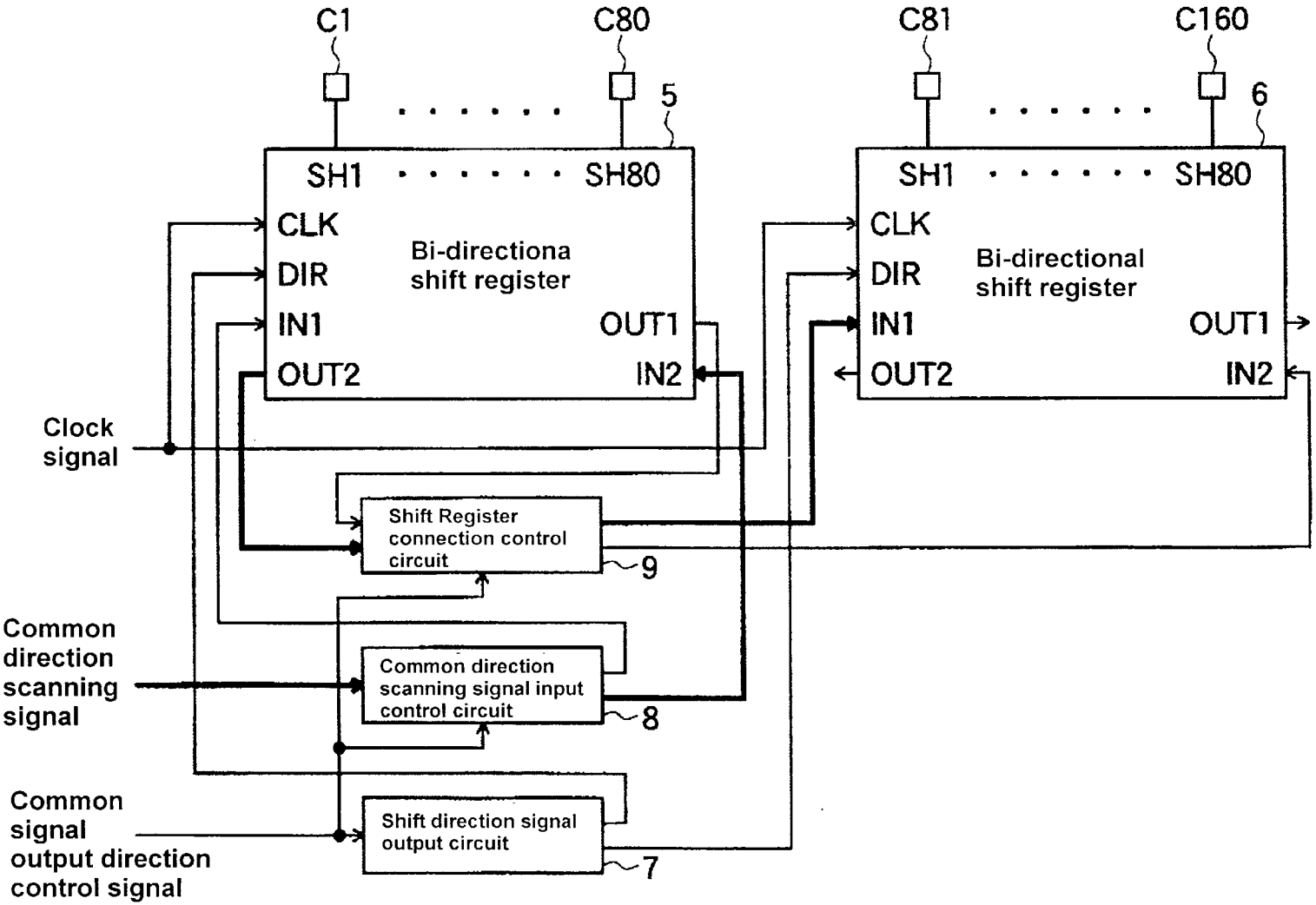
FIG. 2 shows an operation of bi-directional shift registers in FIG. 1.

FIG. 2 shows two bi-directional shift registers 5–6 that are included in the driver IC 2, a shift direction signal output circuit 7 that controls the shift registers 5–6, a common direction scanning signal input control circuit 8, and a shift register connection control circuit 9.

Each of the shift registers 5–6 is equipped with a shift direction signal input DIR, a clock signal input CLK, first and second inputs IN1–IN2, first and second outputs OUT1–OUT2, and shift outputs SH1–SH80.

When a high level signal is input in the shift direction signal input DIR, each of the shift registers 5–6 shifts signals input through the first input IN1 in synchronism with a clock signal input in the clock signal input CLK, and successively outputs the same from the shift outputs SH1–SH80 and the first output OUT1. Also, when a low level signal is input in the shift direction signal input DIR, each of the shift registers 5–6 shifts signals input through the second input IN2 in synchronism with a clock signal input in the clock signal input CLK, and successively outputs the same from the shift outputs SH80–SH1 and the second output OUT2.

The shift outputs SH1–SH80 of the shift register 5 are respectively connected to the common signal output terminals C1–C80 (see FIG. 1). Also, shift outputs SH81–SH160 of the shift register 6 are respectively connected to the common signal output terminals C81–C160 (see FIG. 1).

The shift direction signal output circuit 7 receives a common signal output direction control signal that indicates in what order common signals are output from the common signal output terminals C1–C160, and outputs shift direction signals corresponding to the common signal output direction control signal to the respective shift registers 5–6.

The common direction scanning signal input control circuit 8 receives a common signal output direction control signal, and outputs a common direction scanning signal corresponding to the common signal output direction control signal to the first input IN1 or the second input IN2 of the shift register 5.

The shift register connection control circuit 9 receives a common signal output direction control signal, and connects, according to the common signal output direction control signal, either the first output OUT1 or the second output OUT2 of the shift register 5 to either the first input IN1 or the second input IN2 of the shift register 6.

Next, operations of the shift registers 5–6 are described. In FIG. 2, a clock signal having a specified frequency is regularly input from a clock generator (not shown) in the clock signal inputs CLK of the shift registers 5–6. Also, a common signal output direction control signal, which directs an order to successively output common signals to the common signal output terminals C80–C1, and then to C81–C160, is input in the shift direction signal output circuit 7, the common direction scanning signal input control circuit 8, and the shift register connection control circuit 9.

In response to the common signal output direction control signal, the shift direction signal output circuit 7 outputs a low level signal to the shift direction signal input DIR of the shift register 5, and a high level signal to the shift direction signal input DIR of the shift register 6, respectively. Also, the common direction scanning signal input control circuit 8 transfers the common direction scanning signal to the second input IN2 of the shift register 5. Furthermore, the shift register connection control circuit 9 connects the second output OUT2 of the shift register 5 to the first input IN1 of the shift register 6.

Accordingly, the common direction scanning signal is transferred from the common direction scanning signal input control circuit 8 to the second input IN2 of the shift register 5 along a path indicated by a solid line in FIG. 2, and successively output to the common signal output terminals C80–C1. Then, the common direction scanning signal is transferred from the second output OUT2 of the shift register 5 through the shift register connection control circuit 9 to the first input IN1 of the shift register 6, and successively output to the common signal output terminals C81–C160.

Referring back to FIG. 1, segment signals are successively output from the segment signal output terminals S1–S160 of the driver IC 2. On the other hand, common signals are successively output from the common signal output terminals C80–C1 and C81–C160 of the driver IC 2 by the above-described shift registers 5–6. Accordingly, the LCD panel 3 can be driven by the driver IC 2.

It is possible that any terminals may not be formed at locations opposing to the common signal output terminals C1–C160 of the driver IC 2. However, if any terminals are not formed at locations opposing to the common signal output terminals C1–C160 of the driver IC 2, the driver IC 2 may float on the glass substrate 4 at the locations, and the mounting of the driver IC 2 on the glass substrate 4 becomes unstable. Accordingly, in the driver IC 2 in accordance with the present embodiment, the dummy terminals NC1–NC160 are provided at locations opposing to the common signal output terminals C1–C160 to realize a stable mounting of the driver IC 2 on the glass substrate 4.

Next, another example of an LCD module using a semiconductor device in accordance with one embodiment of the present invention is described with reference to FIG. 3.

Figure 3:
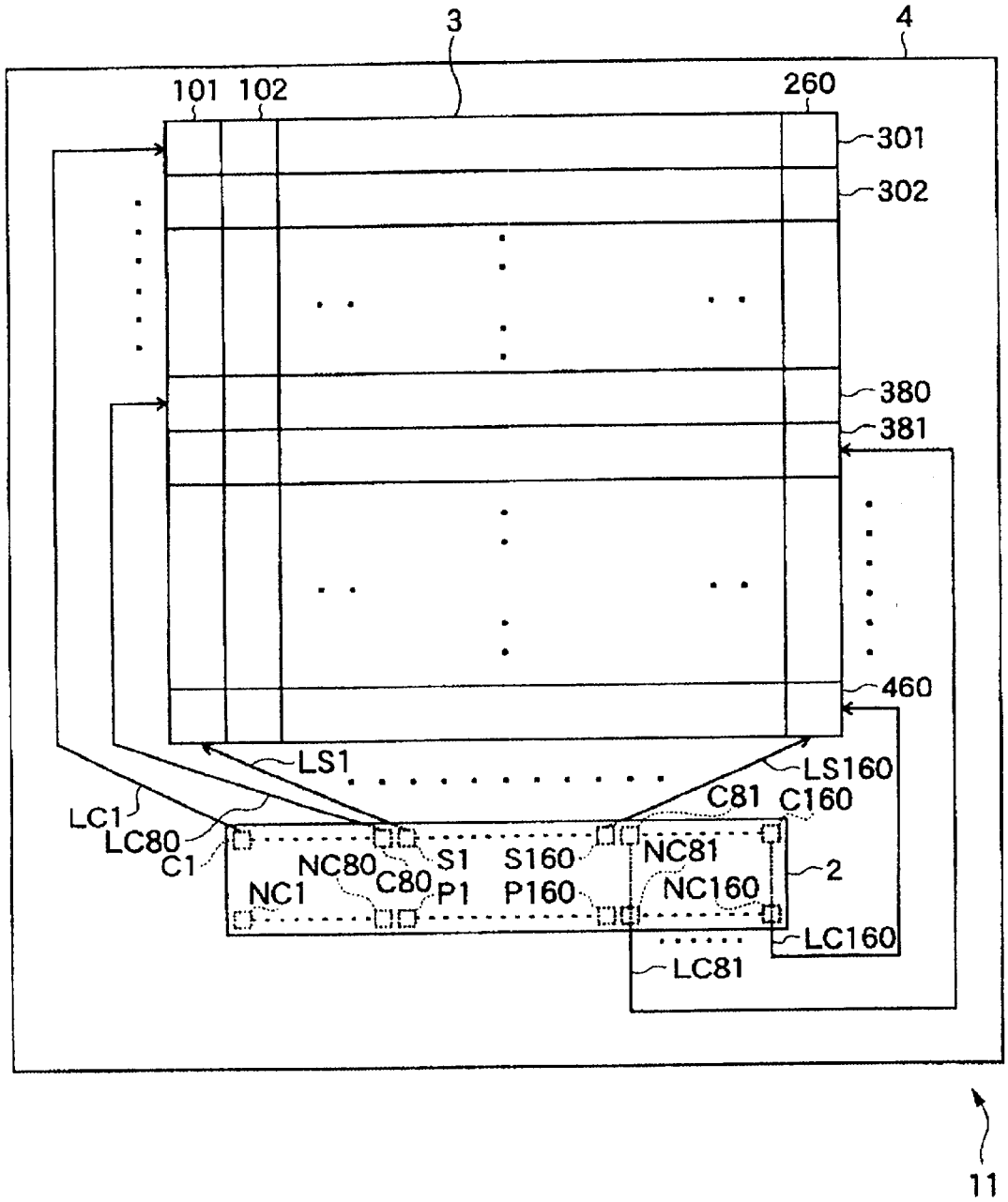
FIG. 3 shows another example of an LCD module using a semiconductor device in accordance with one embodiment of the present invention.

As shown in FIG. 3, the regions 101–260 of the LCD panel 3 are connected to the segment signal output terminals S1–S160 of the driver IC 2 by the wirings LS1–LS160, respectively. Also, the regions 301–380 of the LCD panel 3 are connected to the common signal output terminals C1–C80 of the driver IC 2 by the wirings LC1–LC80, respectively, and the regions 381–460 of the LCD panel 3 are connected to the common signal output terminals C81–C160 of the driver IC 2 by the wirings LC81–LC160, respectively.

Here, the wirings LC1–LC80 are formed in a manner that they extend upwardly (on the left side in the figure) from the common signal output terminals C1–C80 of the driver IC 2, and reach the regions 301–380 from the left side of the LCD panel 3. On the other hand, the wirings LC81–LC160 are formed in a manner that they once extend downwardly (in the figure) from the common signal output terminals C81–C160 of the driver IC 2, pass below the dummy terminals NC81–NC160 and then reach the regions 381–460 from the right side of the LCD panel 3.

Figure 4:
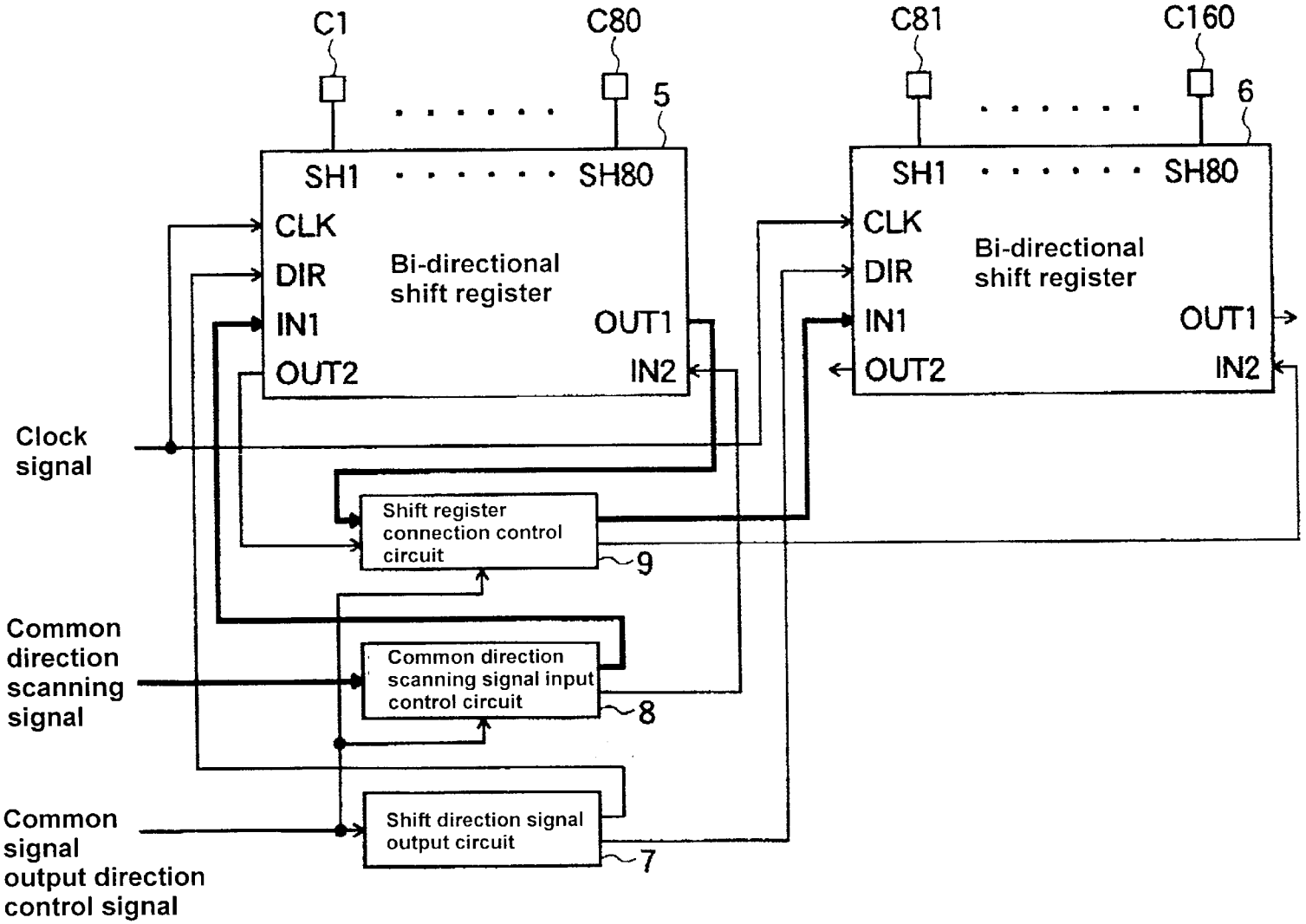
FIG. 4 shows an operation of bi-directional shift registers in FIG. 3.

Next, operations of the shift registers 5–6 are described with reference to FIG. 4. In FIG. 4, a clock signal having a specified frequency is regularly input from a clock generator (not shown) in the clock signal inputs CLK of the shift registers 5–6. Also, a common signal output direction control signal, which directs an order to successively output common signals to the common signal output terminals C1–C80, and then to C81–C160, is input in the shift direction signal output circuit 7, the common direction scanning signal input control circuit 8, and the shift register connection control circuit 9.

In response to the common signal output direction control signal described above, the shift direction signal output circuit 7 outputs a high level signal to the shift direction signal input DIR of the shift register 5, and to the shift direction signal input DIR of the shift register 6. Also, the common direction scanning signal input control circuit 8 transfers the common direction scanning signal to the first input IN1 of the shift register 5. Furthermore, the shift register connection control circuit 9 connects the first output OUT1 of the shift register 5 to the first input IN1 of the shift register 6.

Accordingly, the common direction scanning signal is transferred from the common direction scanning signal input control circuit 8 to the first input IN1 of the shift register 5 along a path indicated by a solid line in FIG. 4, and successively output to the common signal output terminals C1–C80. Then, the common direction scanning signal is transferred from the first output OUT1 of the shift register 5 through the shift register connection control circuit 9 to the first input IN1 of the shift register 6, and successively output to the common signal output terminals C81–C160.

Referring back to FIG. 3, segment signals are successively output from the segment signal output terminals S1–S160 of the driver IC 2. On the other hand, common signals are successively output from the common signal output terminals C1–C80 and C81–C160 of the driver IC 2 by the above described shift registers 5–6. Accordingly, the LCD panel 3 can be driven by the driver IC 2.

As described above, the two shift registers 5–6 within the driver IC 2 are cascade-connected, and each of the shift directions is set in a specified direction. As a result, a routing of wires in a manner as that of the wirings LC1–LC160 can be realized.

Next, still another example of an LCD module using a semiconductor device in accordance with one embodiment of the present invention is described with reference to FIG. 5.

Figure 5:
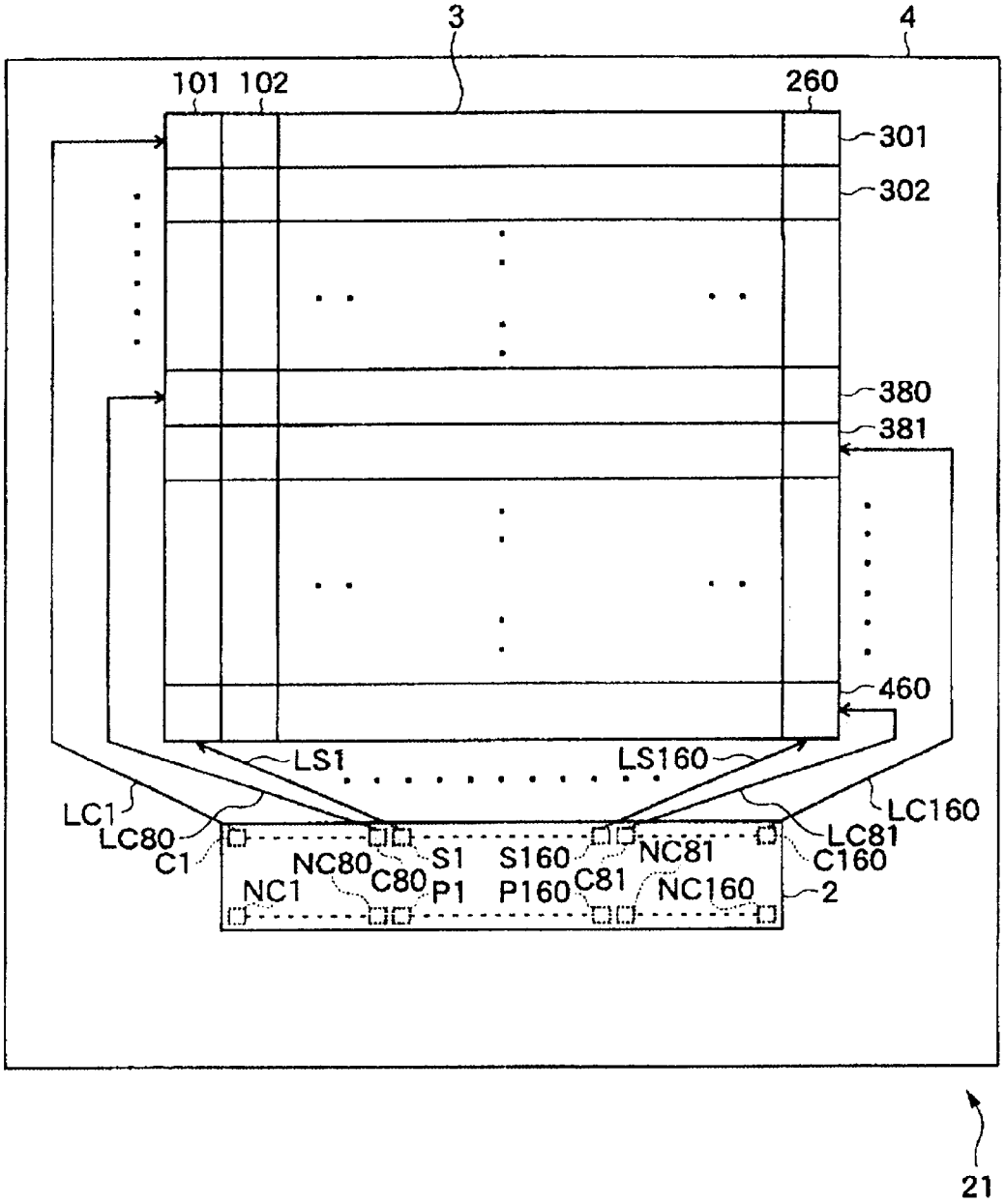
FIG. 5 shows still another example of an LCD module using a semiconductor device in accordance with one embodiment of the present invention.

As shown in FIG. 5, the regions 101–260 of the LCD panel 3 are connected to the segment signal output terminals S1–S160 of the driver IC 2 by the wirings LS1–LS160, respectively. Also, the regions 301–380 of the LCD panel 3 are connected to the common signal output terminals C1–C80 of the driver IC 2 by the wirings LC1–LC80, respectively, and the regions 381–460 of the LCD panel 3 are connected to the common signal output terminals C160–C81 of the driver IC 2 by the wirings LC160–LC81, respectively.

Here, the wirings LC1–LC80 are formed in a manner that they extend upwardly (on the left side in the figure) from the common signal output terminals C1–C80 of the driver IC 2, and reach the regions 301–380 from the left side of the LCD panel 3. On the other hand, the wirings LC160–LC81 are formed in a manner that they extend upwardly (on the right side in the figure) from the common signal output terminals C160–C81 of the driver IC 2, and reach the regions 381–460 from the right side of the LCD panel 3.

Figure 6:
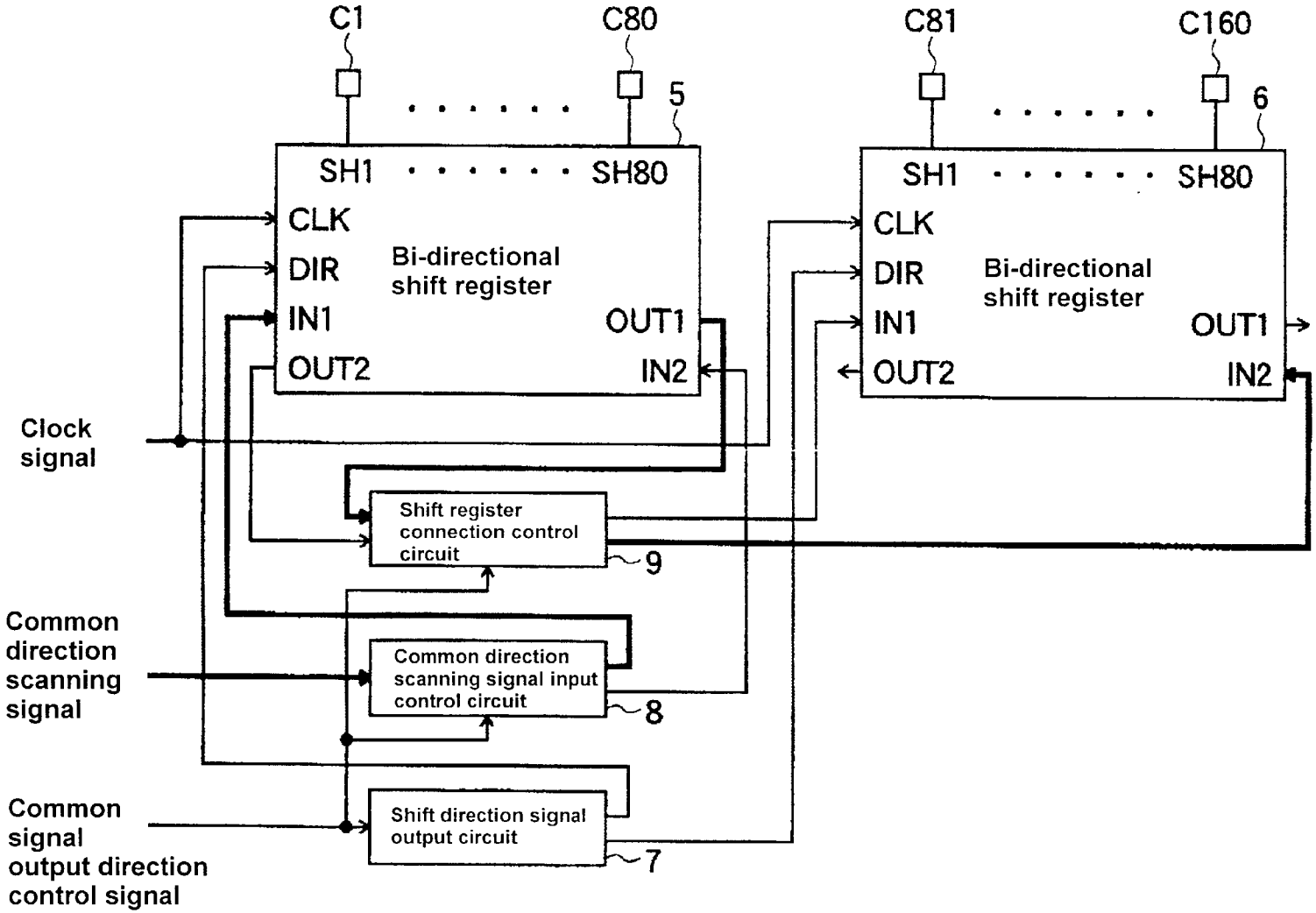
FIG. 6 shows an operation of bi-directional shift registers in FIG. 5.

Next, operations of the shift registers 5–6 are described with reference to FIG. 6. In FIG. 6, a clock signal having a specified frequency is regularly input from a clock generator (not shown) in the clock signal inputs CLK of the shift registers 5–6. Also, a common signal output direction control signal, which directs an order to successively output common signals to the common signal output terminals C1–C80, and then to C160–C81, is input in the shift direction signal output circuit 7, the common direction scanning signal input control circuit 8, and the shift register connection control circuit 9.

In response to the common signal output direction control signal, the shift direction signal output circuit 7 outputs a high level signal to the shift direction signal input DIR of the shift register 5, and a low level signal to the shift direction signal input DIR of the shift register 6, respectively. Also, the common direction scanning signal input control circuit 8 transfers the common direction scanning signal to the first input IN1 of the shift register 5. Furthermore, the shift register connection control circuit 9 connects the first output OUT1 of the shift register 5 to the second input IN2 of the shift register 6.

Accordingly, the common direction scanning signal is transferred from the common direction scanning signal input control circuit 8 to the first input IN1 of the shift register 5 along a path indicated by a solid line in FIG. 6, and successively output to the common signal output terminals C1–C80. Then, the common direction scanning signal is transferred from the first output OUT1 of the shift register 5 through the shift register connection control circuit 9 to the second input IN2 of the shift register 6, and successively output to the common signal output terminals C160–C81.

Referring back to FIG. 5, segment signals are successively output from the segment signal output terminals S1–S160 of the driver IC 2. On the other hand, common signals are successively output from the common signal output terminals C1–C80 and C160–C81 of the driver IC 2 by the above-described shift registers 5–6. Accordingly, the LCD panel 3 can be driven by the driver IC 2.

As described above, the two shift registers 5–6 within the driver IC 2 are cascade-connected, and each of the shift directions is set in a specified direction. As a result, a routing of wires in a manner as that of the wirings LC1–LC 160 can be realized.

As described above, in accordance with the present invention, drive signals that are successively input are supplied to two sets of output terminals in an order that is determined by a control signal. As a result, wirings in a variety of patterns can be provided between a semiconductor device and an image display apparatus, and wirings to the image display apparatus are facilitated. Furthermore, by using the dummy terminals, a stable mounting is realized.

The entire disclosure of Japanese Patent Application No. 2000-376295filed Dec. 11, 2000 is incorporated by reference herein.

What is claimed is:

1. A semiconductor device for supplying a first group of drive signals to a first group of signal electrodes and a second group of drive signals to a second group of signal electrodes of an image display apparatus that displays a two-dimensional image, the semiconductor device comprising:

a first group of output terminals that are arranged in a first region along a first edge in a longitudinal direction of the semiconductor device, and that are adapted to output a specified number of drive signals among the first group of drive signals to the image display apparatus;

a second group of output terminals that are arranged in a second region along the first edge and adjacent to the first region, and that are adapted to output the second group of drive signals to the image display apparatus;

a third group of output terminals that are arranged in a third region along the first edge and adjacent to the second region, and that are adapted to output the remaining drive signals among the first group of drive signals to the image display apparatus;

a first bi-directional register that is adapted to supply the first group of drive signals, which are successively input, to the first group of output terminals, respectively, in an order determined by a control signal;

a second bi-directional register that is cascade-connected to the first bi-directional register and that is adapted to supply the first group of drive signals, which are successively input, to the third group of output terminals, respectively, in an order determined by a control signal;

a first group of dummy terminals arranged corresponding to the first group of output terminals along a second edge in the longitudinal direction of the semiconductor device; and a second group of dummy terminals arranged corresponding to the third group of output terminals along the second edge.

2. A semiconductor device according to claim 1, wherein the image display apparatus is a liquid crystal display apparatus, the first group of drive signals are a plurality of common signals that are respectively supplied to a plurality of common electrodes of the liquid crystal display apparatus, and the second group of drive signals are a plurality of segment signals that are respectively supplied to a plurality of segment electrodes of the liquid crystal display apparatus.

3. A semiconductor device comprising:

a substrate having a first major edge and a second major edge opposite the first major edge;

a plurality of first output terminals disposed in a first region along said first major edge;

a plurality of second output terminals disposed in a second region along said first major edge adjacent said first region;

a plurality of third output terminals disposed in a third region along said first major edge adjacent said second region;

a first bi-directional register coupled to said plurality of first output terminals;

a second bi-directional register cascade-connected to the first bi-directional register and coupled to said plurality of third output terminals;

a plurality of first dummy terminals disposed along said second major edge so as to correspond to said plurality of first output terminals; and a plurality of second dummy terminals disposed along said second major edge so as to correspond to said plurality of third output terminals.

* * * * *